US010269480B2

(12) United States Patent
Ono et al.

(10) Patent No.: US 10,269,480 B2
(45) Date of Patent: Apr. 23, 2019

(54) SOLENOID

(71) Applicant: EAGLE INDUSTRY CO., LTD., Tokyo (JP)

(72) Inventors: Akira Ono, Tokyo (JP); Jun Mihara, Tokyo (JP)

(73) Assignee: EAGLE INDUSTRY CO., LTD. (JP)

( * ) Notice: Subject to any disclaimer, the term of this patent is extended or adjusted under 35 U.S.C. 154(b) by 0 days.

(21) Appl. No.: 15/543,936

(22) PCT Filed: Jan. 26, 2016

(86) PCT No.: PCT/JP2016/052144
§ 371 (c)(1),
(2) Date: Jul. 14, 2017

(87) PCT Pub. No.: WO2016/125629
PCT Pub. Date: Aug. 11, 2016

(65) Prior Publication Data

US 2017/0352462 A1 Dec. 7, 2017

(30) Foreign Application Priority Data

Feb. 2, 2015 (JP) ..... 2015-018813

(51) Int. Cl.
*H01F 7/08* (2006.01)
*H01F 7/16* (2006.01)

(52) U.S. Cl.
CPC ..... *H01F 7/081* (2013.01); *H01F 7/16* (2013.01); *H01F 7/1607* (2013.01); *H01F 2007/086* (2013.01); *H01F 2007/163* (2013.01)

(58) Field of Classification Search
CPC ..... H01F 7/16; H01F 7/081; H01F 7/1607; H01F 2007/086; H01F 2007/163
See application file for complete search history.

(56) References Cited

U.S. PATENT DOCUMENTS

| | | | | |
|---|---|---|---|---|
| 2,853,660 A * | 9/1958 | Immel | H01F 7/1607 335/260 |
| 3,851,285 A * | 11/1974 | Rothfuss | F16H 61/00 251/129.15 |
| 4,741,325 A | 5/1988 | Anota | 126/389 |
| 6,863,255 B2 | 3/2005 | Watanabe et al. | 251/129.21 |

(Continued)

FOREIGN PATENT DOCUMENTS

| | | | |
|---|---|---|---|
| DE | 4436616 A1 * | 4/1996 | H01F 7/081 |
| EP | 2975266 | 1/2016 | F04B 27/18 |

(Continued)

OTHER PUBLICATIONS

International Search Report (w/translation) and Written Opinion (no translation) issued in application No. PCT/JP2016/052144, dated Apr. 19, 2016 (7 pgs).

(Continued)

*Primary Examiner* — Mohamad A Musleh
(74) *Attorney, Agent, or Firm* — Hayes Soloway P.C.

(57) ABSTRACT

Disclosed is a solenoid configured so that vibration and noise in energization can be reduced. The solenoid is configured to use magnetic action in energization of a coil to drive, in an axial direction, a core at least including a first magnetic resistor. The solenoid includes a shaft attached to the core, and bearings supporting both end portions of the core. The solenoid further includes a second magnetic resistor configured to generate force for moving at least the core in a radial direction by the magnetic action.

4 Claims, 3 Drawing Sheets

(56) References Cited

U.S. PATENT DOCUMENTS

| | | | | |
|---|---|---|---|---|
| 7,073,770 | B2 | 7/2006 | Uryu et al. | 251/129.01 |
| 7,973,627 | B2 * | 7/2011 | Yamagata | H01F 7/1607 251/129.15 |
| 8,081,053 | B2 * | 12/2011 | Yamagata | H01F 7/081 251/129.15 |
| 8,469,334 | B2 * | 6/2013 | Yamagata | H01F 7/1607 251/129.07 |
| 2003/0080305 | A1 * | 5/2003 | Schafer | F01L 1/3442 251/129.07 |
| 2003/0136931 | A1 | 7/2003 | Watanabe et al. | 251/129.15 |
| 2004/0155214 | A1 * | 8/2004 | Kirsch | F16K 31/0613 251/129.15 |
| 2004/0257185 | A1 * | 12/2004 | Telep | H01F 7/13 335/220 |
| 2009/0051471 | A1 * | 2/2009 | Zhao | H01F 7/1607 335/261 |

FOREIGN PATENT DOCUMENTS

| | | | |
|---|---|---|---|
| GR | 3000178 | 12/1990 | A47J 27/09 |
| JP | 2001317653 | 11/2001 | F16K 31/06 |
| JP | 2006010046 | 1/2006 | F16K 31/02 |
| JP | 2010129679 | 6/2010 | H01F 7/128 |
| JP | 2014152883 | 8/2014 | B60T 15/36 |
| JP | 2016029270 | 3/2016 | F04B 27/14 |

OTHER PUBLICATIONS

International Preliminary Report on Patentability and translation of Written Opinion issued in application No. PCT/JP2016/052144, dated Aug. 8, 2017 (6 pgs).

Chinese Office Action issued in application No. 201680006066.9, dated Mar. 30, 2018 (8 pgs).

* cited by examiner

SOLENOID

TECHNICAL FIELD

The present invention relates to a solenoid configured to use magnetic action in energization of a coil to drive a core in an axial direction.

BACKGROUND ART

Typically, a solenoid has been known, which is configured to use magnetic action in energization of a coil to drive a plunger (a core) in an axial direction. Such a solenoid includes a shaft attached to the plunger, and bearings supporting both end portions of the plunger (see, for example, Patent Citation 1).

CITATION LIST

Patent Literature

Patent Citation 1: Japanese Laid-open Patent Publication 2010-129679 (page 4, FIG. 1)

SUMMARY OF INVENTION

Technical Problem

In the solenoid of Patent Citation 1, there is a clearance between the shaft attached to the plunger and the bearings supporting both end portions of the plunger, and there is almost no radial restraint force on the plunger. For these reasons, in energization, the plunger moves in the axial direction while the shaft waggles in the bearing clearance, leading to generation of vibration and noise. Particularly in driving by a power source with great voltage/current distortion, such as an AC-DC converter and a DC-DC converter, solenoid vibration and noise tend to be much greater.

The present invention has been made in view of the above-described problems, and is intended to provide a solenoid configured so that vibration and noise in energization can be reduced.

Solution to Problems

In order to solve the above-described problems, a solenoid in a first aspect of the present invention is configured to use magnetic action in energization of a coil to drive, in an axial direction, a core at least including a first magnetic resistor. The solenoid is characterized by including a shaft attached to the core, bearings supporting both end portions of the core, and a second magnetic resistor configured to generate force for moving at least the core in a radial direction by the magnetic action.

According to such a feature of the first aspect, by the force acting at least on the core in the radial direction, the shaft attached to the core is, in energization, pressed against the bearing. Thus, core vibration can be reduced.

The solenoid in a second aspect of the present invention is characterized in that the second magnetic resistor has a magnetic resistance different from that of the first magnetic resistor.

According to such a feature of the second aspect, the first and second magnetic resistors can be easily formed using the materials having different magnetic resistances.

The solenoid in a third aspect of the present invention is characterized in that the second magnetic resistor is non-uniformly provided in the circumferential direction of the core.

According to such a feature of the third aspect, the core is pressed against an optional position in the circumferential direction, and non-uniform force in the circumferential direction is applied. Core swing and vibration can be reduced.

The solenoid in a fourth aspect of the present invention is characterized in that the second magnetic resistor is provided at least at one end portion of the core in the axial direction.

According to such a feature of the fourth aspect, the shaft attached to the core can be pressed against the bearing by force generated at the end portion of the core.

The solenoid in a fifth aspect of the present invention is characterized in that the second magnetic resistor is a cutout.

According to such a feature of the fifth aspect, influence on the entirety of the core can be reduced to the minimum, and the shaft attached to the core can be easily pressed against the bearing.

DESCRIPTION OF EMBODIMENTS

An embodiment of a solenoid according to the present invention will hereinafter be described on the basis of an example.

The solenoid of the embodiment of the present invention will be described with reference to FIGS. 1 and 2.

Figure 1:
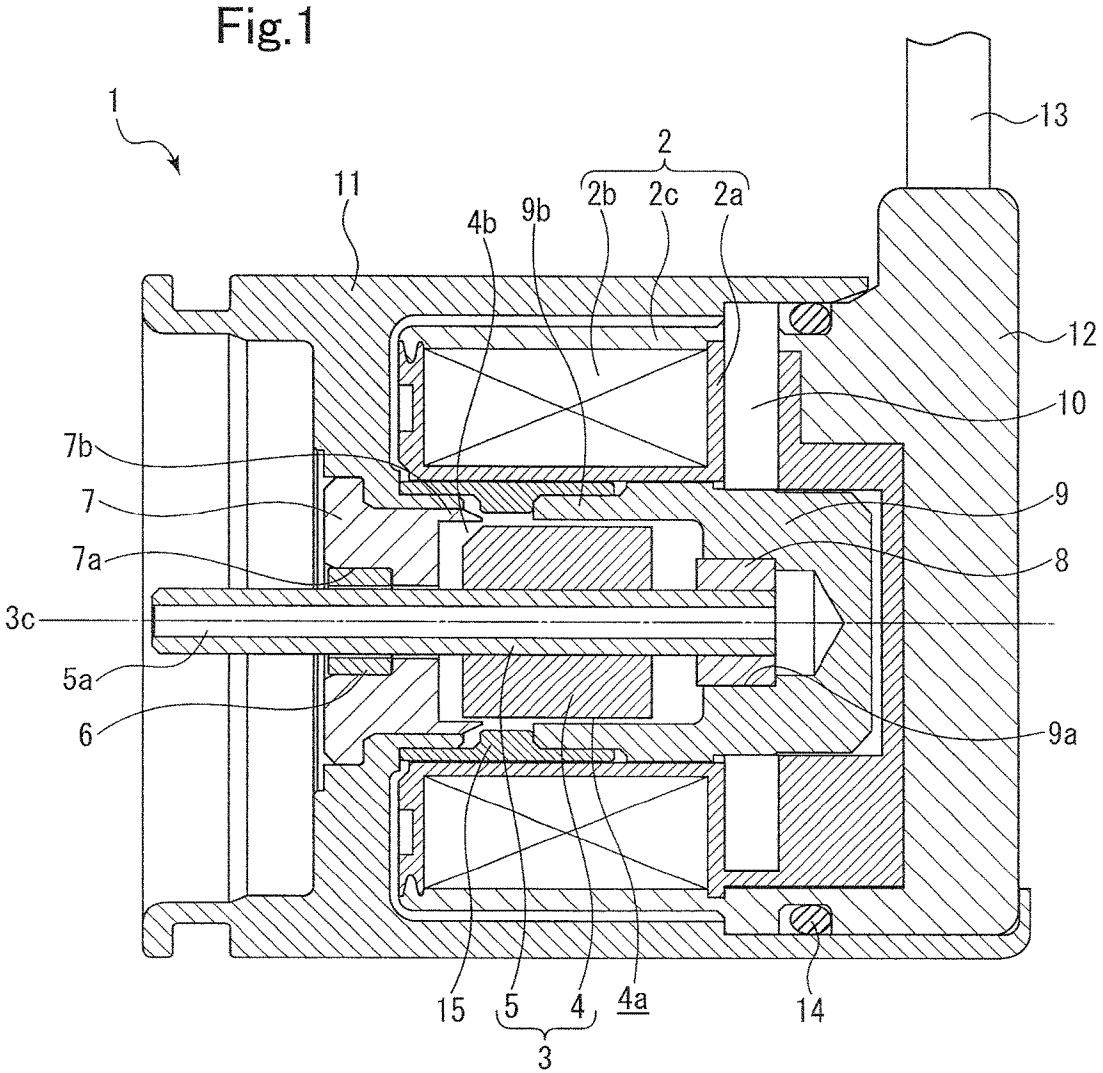
FIG. 1 is a sectional side view of a solenoid in a first embodiment.

As illustrated in FIG. 1, a solenoid 1 mainly includes a coil 2, a movable body 3, a first bearing 6, a second bearing 8, a center post 7, a sleeve 9, a magnetic path plate 10, a body member 11, and a base member 12. Each element forming the solenoid 1 will be described below.

The coil 2 is configured such that a conductor 2*b* covered with enamel is wound predetermined times around a bobbin 2*a* formed of an insulator and that an outer peripheral portion of the wound conductor 2*b* is covered and protected with a covering body 2*c* formed of an insulator. End portions of the conductor 2*b* are connected to lead wires 13, and the coil 2 generates a magnetic flux by power supplied from a not-shown power source.

The movable body 3 is formed such that a shaft 5 is attached to a core 4. The core 4 includes a first magnetic resistor formed of a magnetic body having a low magnetic resistance, such as iron, and is formed in a substantially cylindrical shape with a curved outer peripheral face 4*a*, a flat end face 4*c* (see FIG. 2), and a later-described cutout 4*b* by machining of iron, for example. The entirety of the core 4 is formed of the first magnetic resistor. Alternatively, an isotropic magnet powder core formed in a substantially cylindrical shape by uniform mixing of iron powder having a low magnetic resistance and resin may be used. In this case, the iron powder forms the first magnetic resistor. In order to prevent magnetic flux leakage and efficiently move the movable body, the shaft 5 is formed of a nonmagnetic material such as stainless steel. Moreover, the shaft 5 is provided with a through-hole 5*a* such that working fluid around the movable body 3 does not cause resistance in axial movement of the movable body 3. Thus, the working fluid around the movable body 3 can move in the through-hole 5*a*.

The center post 7 is made of a magnetic material such as iron, and forms part of a later-described magnetic path. The end portion of the center post 7 on the outside of the solenoid 1 is provided with a recess 7*a*, and the end portion of the center post 7 on the inside of the solenoid 1 is provided with an annular flange portion 7*b*. The first bearing 6 is unrotatably attached to the recess 7*a*, and one end portion of the core 4 is housed in an inner space of the flange portion 7*b*.

The sleeve 9 is made of a magnetic material such as iron, and forms part of the later-described magnetic path. A recess 9*a* and a tubular portion 9*b* are formed inside the sleeve 9. The second bearing 8 is unrotatably attached to the recess 9*a*, and the other end portion of the core 4 is housed in an inner space of the tubular portion 9*b*.

The magnetic path plate 10 is made of a magnetic material such as iron, is formed in a discoid shape provided with a hole at the center, and forms part of the magnetic path as described later.

The base member 12 is entirely or partially made of a nonmagnetic material such that no magnetic flux generated by the coil 2 leaks. Moreover, the body member 11 is made of a magnetic material such as iron, and forms part of the later-described magnetic path. The base member 12 is integrally assembled with the base member 12 being hermetically fitted into the body member 11 through a sealing member 14.

As illustrated in FIG. 1, the center post 7 is fitted into the body member 11, the sleeve 9 is fitted into the magnetic path plate 10, and the magnetic path plate 10 is fitted into the body member 11. Moreover, a spacer 15 made of a nonmagnetic material such as resin is disposed between the center post 7 and the sleeve 9. With such a configuration, the movable body 3 is axially movable with the movable body 3 being supported by the first bearing 6 attached to the center post 7 and the second bearing 8 attached to the sleeve 9.

The outer peripheral face 4*a* of the core 4 is supported by the first bearing 6 and the second bearing 8 so as not to contact the annular flange portion 7*b* of the center post 7 and the tubular portion 9*b* of the sleeve 9, i.e., so as to maintain a predetermined gap between the outer peripheral face 4*a* and each of the flange portion 7*b* and the tubular portion 9*b*. Further, in a non-energized state of the coil 2, the movable body 3 is pressed toward the sleeve 9 by not-shown external force such as biasing force.

When the coil 2 is energized, the center post 7 serves as the n-pole, and the sleeve serves as the S-pole, for example. The magnetic flux generated at the coil 2 by energization passes, from the body member 11, through the center post 7, the gap between the center post 7 and the core 4, the core 4, the gap between the core 4 and the sleeve 9, the sleeve 9, and the magnetic path plate 10 in description order. Then, the magnetic flux returns to the body member 11.

When, by energizing the coil 2, the center post 7 and the sleeve 9 are magnetized, the core 4 of the movable body 3 is attracted toward the center post 7. Conversely, when energization of the coil 2 is blocked, the magnetic attractive force for attracting the core 4 toward the center post 7 is eliminated, and thus the movable body 3 returns and stops at an original position by not-shown external force such as biasing force acting on the movable body 3.

At this point, the outer peripheral face 4*a* of the core 4 is supported by the first bearing 6 and the second bearing 8 so as not to contact the annular flange portion 7*b* of the center post 7 and the tubular portion 9*b* of the sleeve 9. Thus, the movable body 3 can be driven by small force without resistance.

However, there is a clearance between the shaft 5 attached to the core 4 and each of the first and second bearings 6, 8 supporting the shaft 5, and there is almost no radial restraint force on the core 4. For this reason, in energization, the shaft waggles in the bearing clearance while the movable body 3 moves in the axial direction, leading to generation of vibration and noise. Particularly in driving by a power source with great voltage/current distortion, such as an AC-DC converter and a DC-DC converter, solenoid vibration and noise tend to be much greater.

For this reason, the core 4 is provided with the cutout 4*b* as a second magnetic resistor configured to use magnetic action in energization of the coil 2 to move the movable body 3 in the radial direction. The features and advantageous effects of the solenoid 1 of the present invention will be described below.

Figure 2:
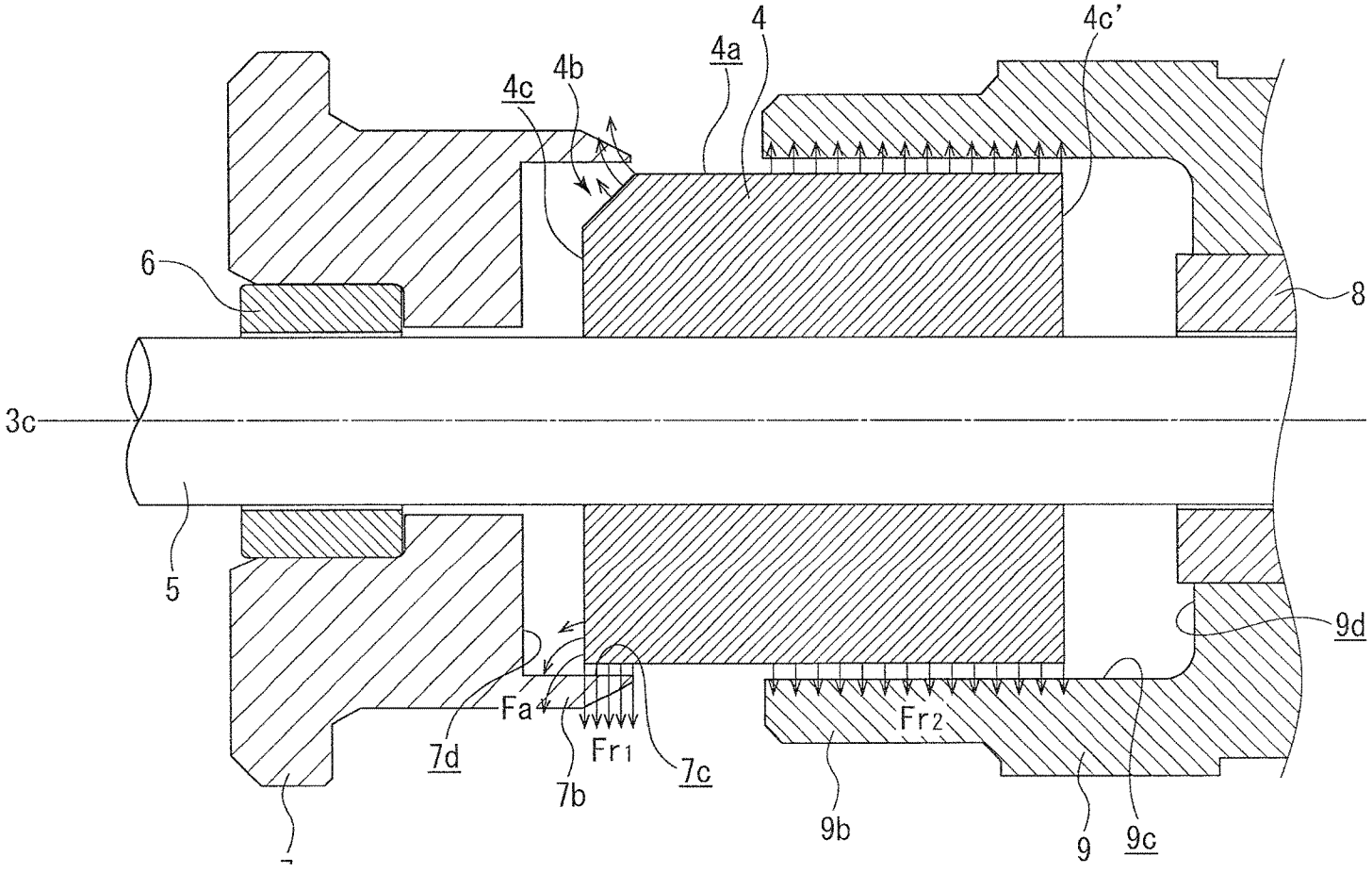
FIG. 2 is an enlarged view of the periphery of a center post, a movable portion, and a sleeve.

As illustrated in FIG. 2, the core 4 is provided with the cutout 4*b* formed in such a manner that part of the outer peripheral face 4*a* of the core 4 and part of the core end face 4*c* are cut out. The cutout 4*b* forms a gap where working fluid such as oil is present, and exhibits a high magnetic resistance. Thus, less magnetic flux generated by energization of the coil tends to pass through the cutout 4*b*, and therefore, the core 4 is not attracted toward the center post. On the other hand, the first magnetic resistor forming the core is made of the material exhibiting a low magnetic resistance, allowing more magnetic flux generated by energization of the coil to pass through the first magnetic resistor, and allowing attraction of the core 4 toward the center post.

The facing area between the outer peripheral face 4*a* of the core 4 and an inner peripheral face 9*c* of the tubular portion 9*b* of the sleeve 9 is large, and the gap between the outer peripheral face 4*a* and the inner peripheral face 9*c* is narrow and exhibits a low magnetic resistance. Thus, almost all of the magnetic flux generated at the coil 2 in energization flows from the outer peripheral face 4*a* of the core 4 toward the inner peripheral face 9*c* of the tubular portion 9*b* of the sleeve 9 by way of the gap. Moreover, the magnetic flux flowing from the outer peripheral face 4*a* of the core 4 toward the inner peripheral face 9*c* of the tubular portion 9*b* of the sleeve 9 is substantially uniform across the entire circumference of the core 4. Thus, radial magnetic force Fr2 between the core 4 and the sleeve 9 is entirely canceled out, and drops to substantially zero.

On the other hand, the gap between the outer peripheral face 4*a* of the core 4 and an inner peripheral face 7*c* of the annular flange portion 7*b* of the center post 7 is small, but the facing area between the outer peripheral face 4*a* and the inner peripheral face 7*c* is small. Thus, the density of magnetic flux from the outer peripheral face 4*a* to the inner peripheral face 7*c* is higher. The magnetic flux also flows from the end face 4*c* of the core 4 to the inner peripheral face 7*c* of the annular flange portion 7*b* of the center post 7 such that the magnetic flux density is lowered. Radial force Fr1 is generated by the magnetic flux between the outer peripheral face 4*a* of the core 4 and the inner peripheral face 7*c* of the annular flange portion 7*b* of the center post 7, and axial force Fra is generated by the magnetic flux from the end face 4*c* of the core 4 to the inner peripheral face 7*c* of the annular flange portion 7*b* of the center post 7. At this point, the gap between the outer peripheral face 4*a* of the core 4 and the inner peripheral face 7*c* of the annular flange portion 7*b* of the center post 7 is large at the portion provided with the cutout 4*b*, and is non-uniform in a circumferential direction.

Thus, the radial magnetic force Fr1 between the core 4 and the center post 7 is greater in a narrow gap portion, and is smaller in a wide gap portion at the cutout 4*b*. Thus, magnetic force entirely acts downward in the radial direction as viewed in the figure. Such downward force in the radial direction acts on the end portion of the core 4 close to the first bearing 6, and therefore, the force of pressing the shaft 5 against the first bearing 6 is greater as compared to the case where magnetic force acts on a center portion of the core 4. With the cutout 4*b* formed at the end portion of the core 4, the shaft 5 can be sufficiently pressed against the first bearing 6 even in the case of other cutouts having the same size as that of the cutout 4*b*. The above-described phrasing of being non-uniform in the circumferential direction means that the cutout as the second magnetic resistor may be provided at a single point in the circumferential direction or may be provided at plural points at unequally-spaced intervals in the circumferential direction.

As illustrated in FIG. 2, axial magnetic force Fa generated by the magnetic flux between the end face 4*c* of the core 4 and the inner peripheral face 7*c* of the annular flange portion 7*b* of the center post 7 serves as drive force of an actuator of the solenoid 1. Such drive force is somewhat decreased due to the presence of the cutout 4*b*, but the size of the cutout 4*b* is sufficiently smaller than the outer circumferential length of the core. Thus, almost no influence is provided on the actuator drive force.

Since the cutout 4*b* is provided at the end portion of the core 4, radial force and axial force can simultaneously act on the movable body 3, and therefore, moment can be generated on the movable body. As a result, the center axis 3*c* (see FIG. 1) of the shaft 5 is biased in a tilting direction, and the shaft 5 contacts inner periphery end portions of the first and second bearings 6, 8. Thus, the contact area is decreased. This can ensure smooth driving of the solenoid 1 even if the force for pressing the shaft 5 against the first bearing 6 increases.

Since both ends of the movable body 3 are supported by the first bearing 6 and the second bearing 8, the gap between the outer peripheral face 4*a* of the core 4 and the inner peripheral face 7*c* of the annular flange portion 7*b* of the center post 7 and the gap between the outer peripheral face 4*a* of the core 4 and the inner peripheral face 9*c* of the tubular portion 9*b* of the sleeve 9 can be maintained substantially uniform. Thus, the actuator can be constantly driven in a stable state without contact between the core 4 and each of the center post 7 and the sleeve 9.

In the solenoid 1 of the present invention, the shaft 5 can be pressed against the first bearing 6 and the second bearing 8, and therefore, vibration and noise of the solenoid 1 in energization can be reduced.

The embodiment of the present invention has been described above with reference to the drawings, but a specific configuration is not limited to that of the embodiment. Even if change or addition is made without departing from the gist of the present invention, such change or addition is included in the present invention.

Figure 3:
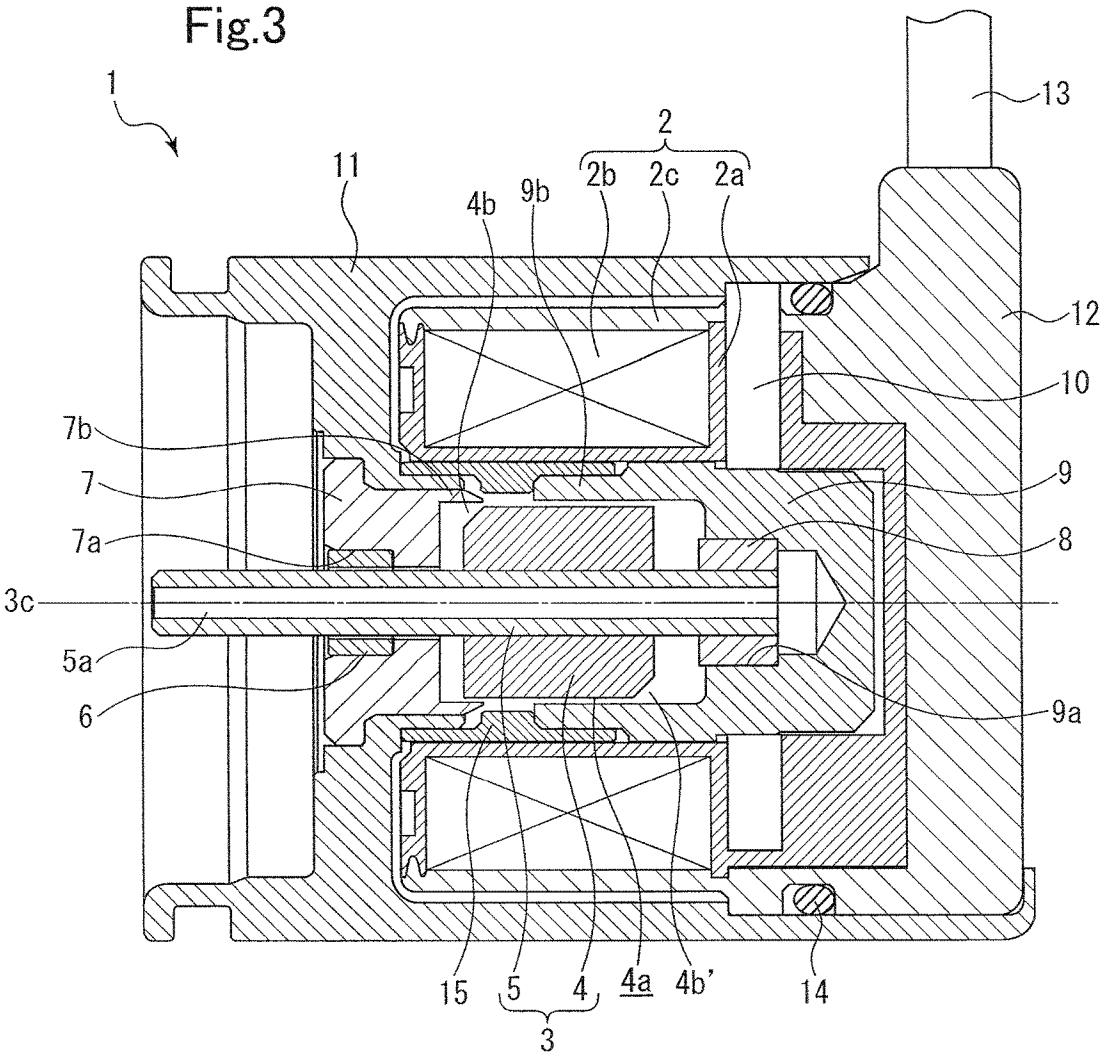
FIG. 3 is a sectional side view of a variation of a second magnetic resistor.

For example, in the above-described embodiment, the cutout 4*b* is provided at one end portion of the core 4. As illustrated in FIG. 3, cutouts are, as a variation of the second magnetic resistor, provided respectively at both end portions of the core 4, and therefore, the shaft 5 can be sufficiently pressed against both of the first bearing 6 and the second bearing 8. As in the above-described embodiment, a gap between a cutout 4*b*' of the core 4 and the inner peripheral face 9*c* of the tubular portion 9*b* of the sleeve 9 and a gap between an end face 4*c*' of the core 4 and the inner peripheral face 9*c* of the tubular portion 9*b* of the sleeve 9 are large, and exhibit high magnetic resistances. Moreover, almost all of the magnetic flux generated at the coil 2 in energization flows from the outer peripheral face 4*a* of the core 4 toward the inner peripheral face 9*c* of the tubular portion 9*b* of the sleeve 9 by way of the gaps. Thus, the magnetic flux flowing from the end face 4C' and the cutout 4*b*' of the core 4 is extremely small, and therefore, upward magnetic force in the radial direction as viewed in the figure acts due to the presence of the cutout 4*b*'. The downward magnetic force acting in the radial direction as viewed in the figure by the cutout 4*b* and the upward magnetic force acting in the radial direction as viewed in the figure by the cutout 4*b*' act as force for rotating the shaft 5 counterclockwise, and the shaft 5 can be, with greater force, pressed against both of the first bearing 6 and the second bearing 8. Alternatively, the cutouts at both end portions of the core 4 may be provided with the same phase, or may be provided with a phase difference. Note that the size and number of cutouts may be determined according to conditions.

In the above-described embodiment, the cutout 4*b* is provided at one end portion of the core 4. However, a protrusion made of the same material as that of the core 4 may be provided at the core 4 as a variation of the second magnetic resistor.

In the above-described embodiment, the cutout 4*b* is provided at the core 4 to change the magnetic resistance of the core 4 in the circumferential direction. However, a member made of a material having a magnetic resistance different from that of the main material of the core 4 may be, as a variation of the second magnetic resistor, attached to the core 4 so as to fill the cutout of the core 4, and as a result, the entirety of the core 4 may be formed in a cylindrical shape. Alternatively, second and third magnetic resistor members having different magnetic resistances may be attached to the core 4.

The above-described variations may be implemented in combination.

REFERENCE SIGNS LIST

1 Solenoid
2 Coil
3 Movable body
3*c* Center axis
4 Core (first magnetic resistor)
4*b* Cutout (second magnetic resistor)
5 Shaft
6 First bearing (bearing)
8 Second bearing (bearing)

The invention claimed is:

1. A solenoid comprising:

a shaft;

a core having a first magnetic part having a first magnetic permeability and fixedly pierced with the shaft;

a coil arranged to surround the core and configured to drive the core in a axial direction of the core upon energization of the coil;

a pair of bearings each arranged around each of end portions of the shaft protruding from the core for supporting the core through the shaft; and a second magnetic part having a second magnetic permeability different from that of the first magnetic part and configured to generate a radial force in the core upon energization of the coil for biasedly pushing the shaft against the bearings, the core being provided with a first cutout forming by partially cutting out a circular edge of one of end portions of the core opposed to each other in the axial direction, wherein the cutout is formed as the second magnetic part.

2. The solenoid as set forth in claim 1, wherein:

the second magnetic part is non-uniformly provided in a circumferential direction of the core.

3. The solenoid as set forth in claim 1, wherein:

the core is further provided with a second cutout formed by partially cutting out a circular edge of other one of end portions of the core opposed to each other in the axial direction of the core, wherein both the first and the second cutouts are formed as the second magnetic part.

4. The solenoid as set forth in claim 3, wherein:

the second magnetic part is non-uniformly provided in a circumferential direction of the core.

* * * * *